United States Patent [19]

Bohlender et al.

[11] Patent Number: 4,814,584

[45] Date of Patent: Mar. 21, 1989

[54] PROFILED PCT HEATER FOR HEATING A TUBULAR MEMBER

[75] Inventors: Franz Bohlender, Kandel; Norbert Buchlaub, Hagenbach, both of Fed. Rep. of Germany

[73] Assignee: David & Baader - DBK, Kandel, Fed. Rep. of Germany

[21] Appl. No.: 103,055

[22] Filed: Sep. 30, 1987

[30] Foreign Application Priority Data

Oct. 1, 1986 [EP] European Pat. Off. ..... 86113472.4

[51] Int. Cl.[4] ..... H05B 3/10; H05B 1/02; H01C 7/02; F24H 1/12

[52] U.S. Cl. ..... 219/535; 219/301; 219/302; 219/505; 219/530; 219/539; 219/541; 219/544; 338/22 R

[58] Field of Search ..... 219/301, 302, 535, 505, 219/504, 530, 540, 544, 541, 548, 537–539, 552, 553; 338/22 R

[56] References Cited

U.S. PATENT DOCUMENTS 4,091,267 5/1978 Grant ..... 219/505 X

FOREIGN PATENT DOCUMENTS 2002254 2/1971 Fed. Rep. of Germany .
2263020 7/1973 Fed. Rep. of Germany .
2614433 10/1976 Fed. Rep. of Germany .
3042420 6/1982 Fed. Rep. of Germany .

*Primary Examiner*—Anthony Bartis

[57] ABSTRACT

A PTC heater for heating a tubular member includes an elongated profiled carrier body of heat conductive material having a first side provided with a flat support surface having a groove substantially perpendicular thereto extending along opposite longitudinal edges thereof and a second side provided with a channel of semi-circular cross-section for engaging the tubular member. A PTC heater element comprising a plurality of PTC resistance elements disposed between a pair of plate electrodes is positioned on the flat support surface in heat transmitting contact therewith and is covered by an elongate heat conductive cover member in flat surface engagement with the other side of the PTC heater element and provided with longitudinal rim portions closely fitted into the grooves. A U-shaped straddle clamping bracket having legs snap-fittingly anchored to the carrier body presses the cover toward the PTC heater element and carrier body. The profiled body may be provided with a pair of support surfaces disposed at an angle and each supporting a PTC heater element covered by a cover member as described above.

8 Claims, 3 Drawing Sheets

9
24
8
20
6
4
18
23
22
23
20
3
20
18
PTC
HEATING
ELEMENT
20
16
6
17
17
2
5
7
19
21
19
21
10
13
12
14
13
12
15
11
15
14
1

PROFILED PCT HEATER FOR HEATING A TUBULAR MEMBER

The invention relates to a PTC heater consisting of an elongate profiled carrier body of a heat-conductive material having at least one flat support surface and at least one PTC heater element supported thereon with one side thereof in heat-transmitting contact with said, at least one, flat support surface, each of said at least one PTC heater element being composed of an upper and a lower plate electrode and at least one PTC resistance element disposed therebetween in electrical contact therewith, a heat conductive cover member having a surface portion in flat surface engagement with the other side of said, at least one, PTC heater element, and clamping means for clamping said profiled carrier body and said cover member together.

A heater of this type is known from DE-OS 30 42 420.

PTC heaters of the type defined above usually contain a plurality of flat heater elements retained at spaced positions as by means of an insulating plate member formed with passages for receiving said heater elements therein, and clamped between two plate electrodes for the supply of current to the heater elements. The heat generated by the PTC heater elements is emitted from their flat sides, requiring an efficient heat-transmitting connection between the PTC heater and a heat sink acting as a consumer.

For obtaining efficient heat transmission from a PTC heater it is known from DE-AS 20 02 254 to embed the heat-generating PTC heater element in paraffin within a housing so that the generated heat is transmitted from all sides of the heater element by heat conduction. Also from DE-OS 22 63 020 it is known to embed the PTC heater element in a thermally conductive and electrically insulating compound within a surrounding housing.

From DE-PS 26 14 433 it is known to transmit the heat from flat PTC heater elements disposed within a surrounding shell to this shell by the use of resilient sheet metal members each having a leg in flat surface engagement with a respective heater element and an arcuate leg engaging the wall of the shell. In this manner the generated heat uniformly from both sides of the heater elements to the shell.

There are numerous applications requiring the generated heat to be transmitted to a heat consumer device in only a single direction. An example of such an application is shown in US-PS 40 91 267 relating to an electric water heater consisting of a vessel heated from outside by means of a PTC heater. This heater is mounted on one sidewall of the vessel and contains a PTC heater element disposed within a housing in surface engagement with a housing wall and embedded in a ceramic film compound. Due to different heat output characteristics at opposite sides of the heater element, this arrangement may result in the heater element getting warmer on one side than on the other, so that its resistance increases correspondingly and optimum heat generation is not ensured.

There are also applications requiring pipe conduits to be heated, for instance the rectification column in an absorption refrigerating installation. In applications of this kind the generated heat has thus to be transmitted from a usually flat heater element to a heat sink having a convex surface. With respect to the transmission of heat an application of this type is extremely unfavourable, because it requires heat to be transmitted from a two-sided heat emitter to a one-sided heat sink. In cases like this there is thus a considerable danger that the self-limiting effect of the heater element is activated prematurely and that therefore the heating capacity of the PTC element is not fully utilized.

It is an object of the present invention to provide a PTC heater of the type defined in the introduction which is particularly well suited for heating a tubular heat sink.

The invention thus provides a PTC heater in which the rim portions angularly projecting from the cover member are effective to direct the heat received by the cover member substantially in the same direction in which the side of the PTC heater element facing away from the cover member emits the generated heat. The heat emitted from both sides of the PTC heater element is thus directed substantially to only one side whereat it can be transmitted to a heat sink received in the channel formed in the profiled carrier body. In particular, this channel may be of semicircular cross-sectional shape, so that a tube of circular cross-sectional shape can be received therein.

According to an important aspect of the invention, the individual components of the heater can be assembled in a very simple manner without any bending or embedding operations. The individual components merely have to be suitably stacked upon one another, and are subsequently clamped together or secured to one another by means of at least one clamping bracket.

Embodiments of the invention shall now be described by way of example with reference to the accompanying drawings, wherein.

Figure 1:
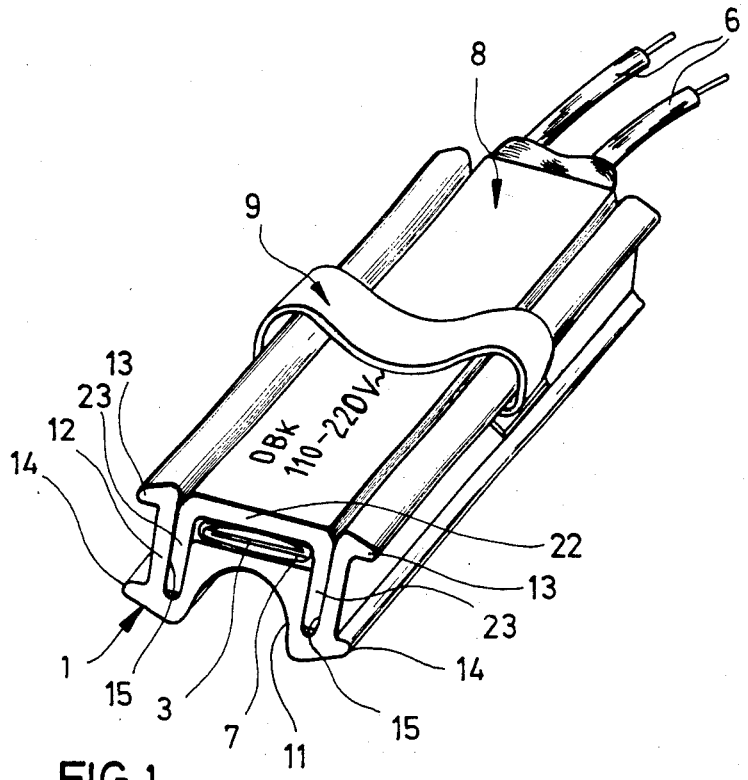
FIG. 1 shows a PTC heater according to a first embodiment of the invention.
Figure 2:
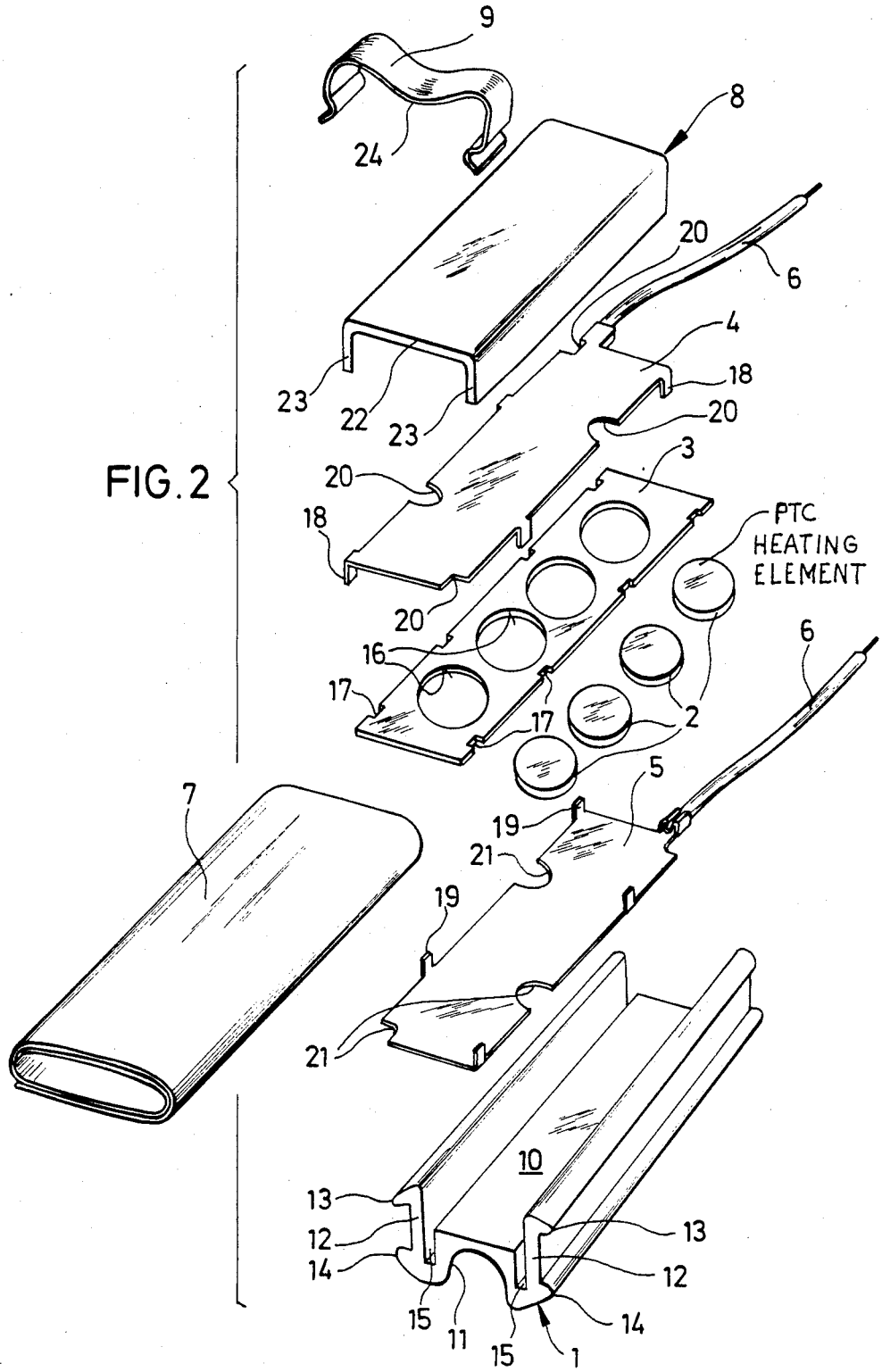
FIG. 2 shows an exploded perspective view of the heater of FIG. 1.

As shown in FIGS. 1 and 2, a PTC heater comprises a profiled carrier body 1, a PTC heater element composed in the present case of four PTC resistance elements 2 (fig.2), a positioning plate 3 for securing PTC resistance elements 2 in position, and upper and lower contact plates 4 and 5 including supply conductors 6, an insulating sheet 7, a heat conductor member 8, and a spring clamp bracket 9.

Profiled carrier body 1 is made of a highly heat-conductive material such as aluminum or copper, and has a flat support surface 10 for receiving the PTC heater element thereon. Formed below support surface 10 is a channel 11 of substantially semicircular cross-sectional shape in the present example. Extending upwards from the lower ends of the walls defining channel 11 are walls 12 having laterally projecting rims 13 and 14 adjacent their upper and lower ends. Respective grooves 15 are formed between these outer walls 12 and the walls defining channel 11.

Positioning plate 3 is formed with four passages 16 adapted to receive PTC resistance elements 2 therein in a snug fit. Positioning plate 3 is of an insulating material and has its lateral edges formed with notches 17. The longitudinal edges of contact plates 4 and 5 are provided with projecting lugs 18, 19 and cutouts 20, 21. The lugs and cutouts of the two contact plates are aligned relative to one another in such a manner that there is no direct contact between the two contact plates after the heater element has been assembled by sandwiching the contact plates, the positioning plate and the PTC resistance elements and bending the lugs down for securing the assembly. This construction of the PTC heater element is already known from DE-OS 30 42 420.

The heater element is wrapped in insulating sheet 7 (cf. fig.1) and supported in this state on support surface 10. Insulating sheet 7 is effective to electrically insulate the heater element from profiled carrier body 1 while ensuring effective heat transmission. To this purpose it consists of a highly heat-conductive material. The top of the thus insulated heater element is covered by heat conductor member 8 formed of a highly heat-conductive material and having a cover plate portion 22 with lateral rim portions 23 angularly projecting therefrom to be received in grooves 15 of profiled carrier body 1 in close contact with the walls thereof. Heat conductor member 8 is retained in place by spring clamp bracket 9 which is anchored to oppositely projecting rims 13 of walls 12 in a snap fit as illustrated in FIG. 1. The center portion of spring clamp bracket 9 is preferably provided with a curvature 24 resiliently engaging the top surface of heat conductor member 8. A plurality of such spring clamp brackets may be employed when a particularly strong biasing force is required to thereby achieve an improved transmission of heat to profiled carrier body 1.

In use of the heater, the heat emitted from the heater element through contact plates 4, 5 and insulating sheet 7 is on one side directly received by profiled carrier body 1, and on the other side by cover plate member 22 of heat conductor member 8, from where it is transmitted through rim portions 23 to the lower portions of profile carrier body 1 adjacent channel 11.

A not shown spring clamp bracket of the type described and adapted to engage rims 14 may be used for clamping profiled carrier body 1 to a likewise not shown pipe for transmitting heat thereto. It should be noted that the cross-sectional shape of channel 11 need not be semicircular, but may also be any other suitable shape corresponding to the contours of a body to be heated.

Figure 3:
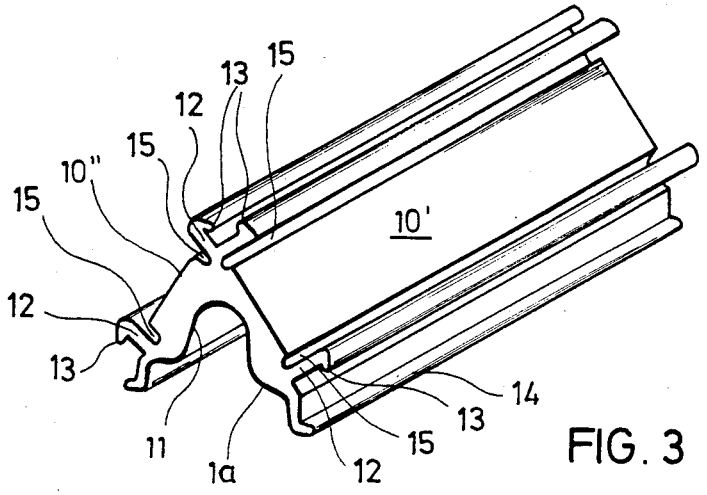
FIG. 3 shows a profiled carrier body according to a second embodiment of the invention.

FIG. 3 shows a modified embodiment of a profiled carrier body 1' having two support surfaces 10', 10'' including respective walls, grooves etc. and disposed at an angle relative to one another so as to enclose channel 11 therebetween. In this manner it is possible to mount two PTC heater elements on one profiled carrier member or to provide alternative mounting positions for a single heater element.

It should be noted that an insulating sheet need not be employed when the profiled carrier body is made of an insulating material, for instance a ceramic material. As an alternative, the insulation may be accomplished by means of insulating plates as already known per se from prior art.

For ensuring efficient heat transmission from the top side of the PTC heater element to channel 11 it is important that rim portions 23 and grooves 15 be dimensioned to achieve a close fit therebetween to result in heat conducting bridges of sufficient dimensions. Such a fit may be further improved by a certain resiliency of the material of the profiled carrier body, permitting the walls of grooves 15 to be wedged slightly appart on insertion of the suitably dimensioned rim portions.

It should be finally mentioned that in place of projecting rims 13 and 14 walls 12 may be formed with suitable grooves 25 for snap engagement of one or more spring clamp brackets of corresponding shape.

Figure 4:
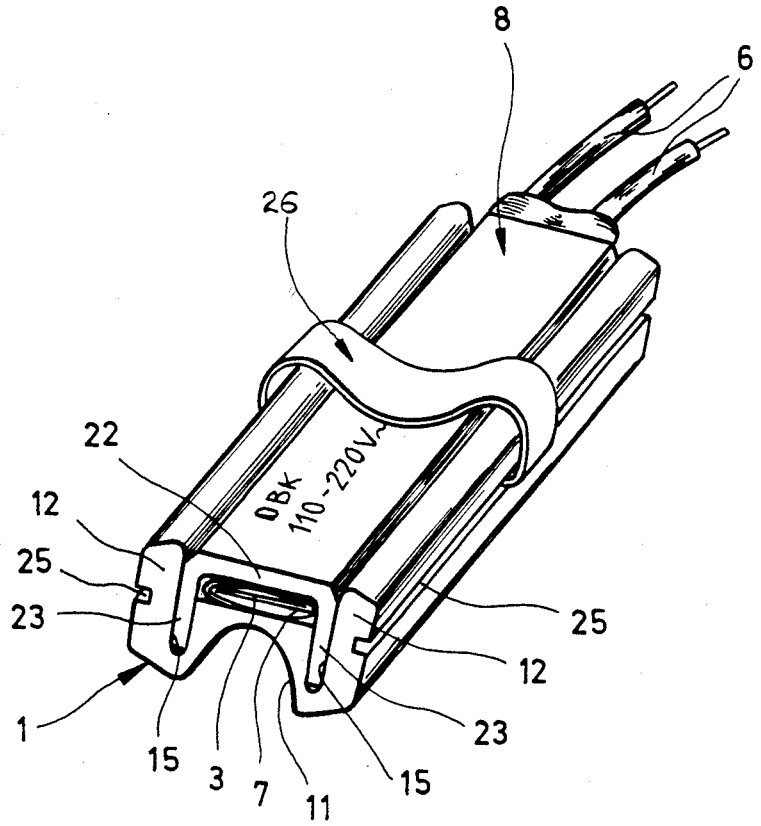
FIG. 4 shows a PTC heater similar to the first embodiment of the invention but having a different type of fixture of a spring clamp bracket.

This embodiment is shown in FIG. 4. The grooves 25 shown there may serve for the attachment of spring clamp brackets 26 for clamping the profiled carrier body to a not shown pipe for transmitting heat thereto, as well.

We claim:

1. A PTC heater consisting of an elongate profiled carrier body of a heat-conductive material having at least one flat support surface and at least one PTC heater element supported thereon with one side thereof in heat-transmitting contact with said at least one flat support surface, each of said at least one PTC heater element being composed of an upper and a lower plate electrode and at least one PTC resistance element disposed therebetween in electrical contact therewith, a heat conductive cover member having a surface portion in flat surface engagement with the other side of said at least one PTC heater element, and clamping means for clamping said profiled carrier body and said cover member together, the side of said profiled carrier body facing away from said at least one PTC heater element being formed with a channel of a cross-sectional shape opening at the side facing away from said at least one PTC heater element, said profiled carrier body being further provided with at least one pair of grooves the grooves of each pair extending in longitudinal direction at either side of each of said at least one support surface substantially perpendicular thereto, said cover member at both longitudinal edges of said surface portion engaging said PTC heater element being provided with rim portions extending at an angle therefrom and closely fitted into said grooves of said profiled carrier body, and said clamping means consisting of at least one straddle spring bracket of substantially U-shaped cross-section with its center portion pressing said cover member toward said carrier body and its outer legs anchored to said profiled carrier body.

2. A heater according to claim 1, characterized in that said center portion of said straddle spring bracket has a curvature facing said cover member.

3. A heater according to claim 1 or 2, characterized in that said profiled carrier body is provided at both sides with a laterally projecting, longitudinally extending rim to which said straddle spring bracket outer legs are anchored in a snap fit.

4. A heater according to claim 1, characterized in that at locations adjacent both sides of the opening of said channel said profile carrier body is provided with means for anchoring a mounting bracket.

5. A heater according to claim 1, characterized in that said profiled carrier body is formed with two such flat support surfaces disposed at an angle relative to one another in a roof-type configuration with said channel therebetween.

6. A heater according to claim 1, characterized in that said profiled carrier body and said cover member consist of a metal, and each of said at least one PTC heater element being electrically insulated therefrom by an insulation of a highly heat-conductive electrically insulating material.

7. A heater according to claim 6, characterized in that said insulation is formed by a foil wrapped around each of said at least one PTC heater element.

8. A heater according to claim 1, characterized in that said channel is of substantially semicircular cross-sectional shape.

* * * * *